US005476296A

United States Patent [19]

Gross

[11] Patent Number: 5,476,296

[45] Date of Patent: Dec. 19, 1995

[54] PET WASTE PICK-UP DEVICE

[76] Inventor: Richard Gross, 19 Stanford Dr., Rancho Mirage, Calif. 92270

[21] Appl. No.: 339,410

[22] Filed: Nov. 14, 1994

[51] Int. Cl.[6] ..... A01K 29/00; E01H 1/12

[52] U.S. Cl. ..... 294/1.3

[58] Field of Search ..... 294/1.3–1.5, 8.5, 294/11, 25, 28, 33, 50.8, 55, 99.2; 15/257.1, 257.4, 257.6; 119/161

[56] References Cited

U.S. PATENT DOCUMENTS

| | | | |
|---|---|---|---|
| 832,317 | 10/1906 | Hinds | 294/99.2 |
| 1,538,536 | 5/1925 | Wisoff | 294/99.2 X |
| 1,726,207 | 8/1929 | Beck | 294/99.2 X |
| 1,775,571 | 9/1930 | Romer | 294/99.2 X |
| 3,767,247 | 10/1973 | Wetzler | 294/1.3 |
| 3,778,097 | 12/1973 | Dorzan . | |
| 3,897,079 | 4/1975 | Nicholas . | |
| 4,188,055 | 3/1980 | Green | 294/1.3 |
| 4,194,777 | 3/1980 | Carns . | |
| 4,196,928 | 4/1980 | Spangler . | |
| 4,200,321 | 4/1980 | Warkentin . | |
| 4,273,370 | 6/1981 | Kiaer | 294/1.3 |
| 4,323,272 | 4/1982 | Fortier | 294/1.4 |
| 5,344,200 | 9/1994 | Yoshioka . | |

FOREIGN PATENT DOCUMENTS

| | | | |
|---|---|---|---|
| 1196938 | 11/1985 | Canada | 294/1.3 |
| 2644810 | 9/1990 | France . | |
| 2652102 | 3/1991 | France . | |
| 2639518 | 3/1978 | Germany . | |
| 3822840 | 1/1990 | Germany | 294/1.3 |
| 4008295 | 10/1991 | Germany | 294/1.3 |
| 8004310 | 7/1980 | Netherlands . | |
| 8901-465-A | 6/1989 | Netherlands . | |
| 8802356 | 4/1990 | Netherlands | 294/1.3 |
| 651873A5 | 10/1985 | Switzerland . | |
| 2273454 | 6/1994 | United Kingdom | 294/1.3 |

*Primary Examiner*—Johnny D. Cherry
*Attorney, Agent, or Firm*—Blakely, Sokoloff, Taylor & Zafman

[57] ABSTRACT

An animal waste disposal device. The device includes a body which has both a first wall and a second wall that rotate about a hinge integrally formed within the body. The device also has an arcuate shaped handle that is attached to the body and biases the walls into an open position. The walls hold a detachable disposable bag that collects the animal waste. The user can manipulate the walls to collect and capture the animal waste within the bag. The device may have a locking tab that cooperates with an aperture in the body to lock the walls in the closed position and seal the contents of the bag.

9 Claims, 3 Drawing Sheets

PET WASTE PICK-UP DEVICE

BACKGROUND OF THE INVENTION

1. Field of the Invention

The present invention relates to a device for capturing animal waste.

2. Description of Related Art

When walking a dog, it is preferable if the owner collects any animal waste deposited by the animal. A conventional way to collect such waste is to utilize a shovel and a bag. Manipulating a shovel is not always the most efficient manner for collecting the waste. Additionally, when walking a pet, carrying a shovel and a separate bag can be cumbersome.

There are devices that assist in the collection of animal waste. For example, U.S. Pat. No. 4,194,777 issued to Carns discloses a dog waste scoop which has a pair of jaws that can grasp the waste. The jaws are biased into a closed position by a spring and rotated into an open position by a lever that is pulled by the operator. The Carns device contains a number of different components which increase the cost of producing the device. Additionally, the Cams device requires a certain amount of dexterity to operate the waste scooper. It would be desirable to have a waste collection device that was simple to operate and inexpensive to produce.

SUMMARY OF THE INVENTION

The present invention is an animal waste disposal device. The device includes a body which has both a first wall and a second wall that rotate about a hinge integrally formed within the body. The device also has an arcuate shaped handle that is attached to the body and biases the walls into an open position. The walls hold a detachable disposable bag that collects the animal waste. The user can manipulate the walls to collect and capture the animal waste within the bag. The device may have a locking tab that cooperates with an aperture in the body to lock the walls in the closed position and seal the contents of the bag.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
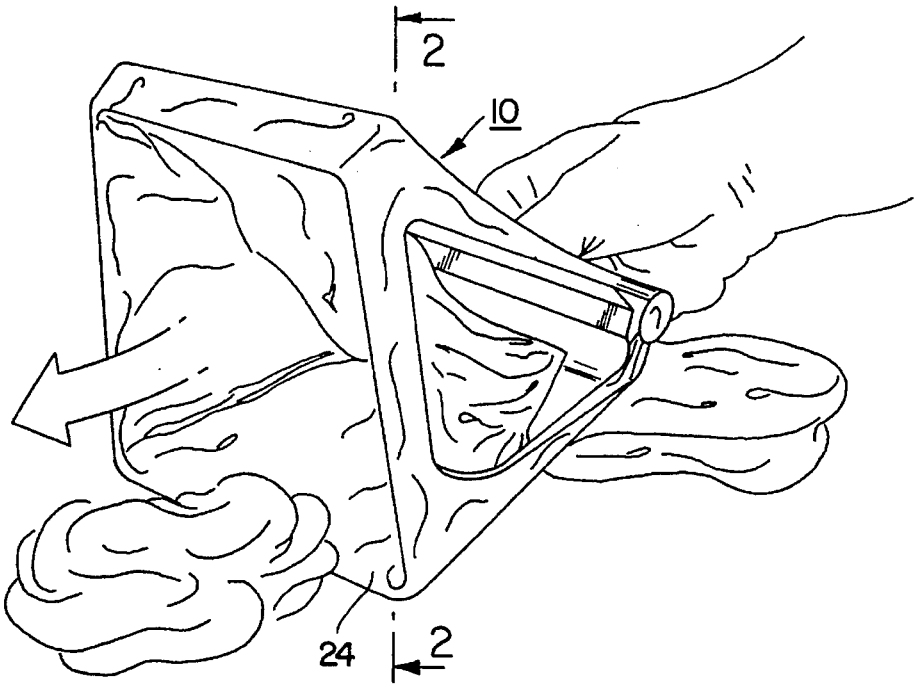
FIG. 1 is a perspective view of a waste container of the present invention.

Referring to the drawings more particularly by reference numbers, FIGS. 1–8 show a waste container of the present invention. The waste container 10 is typically used by an end user to collect and dispose of waste such as animal feces. The container 10 is typically small enough to be carried and manipulated by a single hand, thus allowing the operator to hold the animal with one hand and collect the feces with the other hand.

The container 10 includes a body 12 which has a first wall 14 and a second wall 16. The walls 14 and 16 rotate about a hinge 18 integrally formed within the body 12. In the preferred embodiment, the body 12 is constructed from a molded plastic piece which has a notched channel that forms the hinge 18. The walls 14 and 16 can move between the open position shown in FIG. 2, and the closed position shown in FIG. 5.

Extending from the second wall 16 is a U-shaped wire 20 that defines a bag opening 22. The ends of the wire 20 are inserted into corresponding holes in the second wall 16. The wire 20 is typically constructed from metal that can scrape a surface to collect the animal waste. A disposable bag 24 can be placed over the walls 14 and 16 to expose an inner opening of the bag 24. For bags that are larger than the device, the excessive bag material can be inserted through the bag opening 22 defined by the U-shaped wire 20. The user can collect waste by pushing the waste item(s) into the bag opening and rotating the walls 14 and 16 into the closed position. The first wall 14 may have a lip 26 that closes the bag 24 when the walls are in the closed position.

Figure 2:
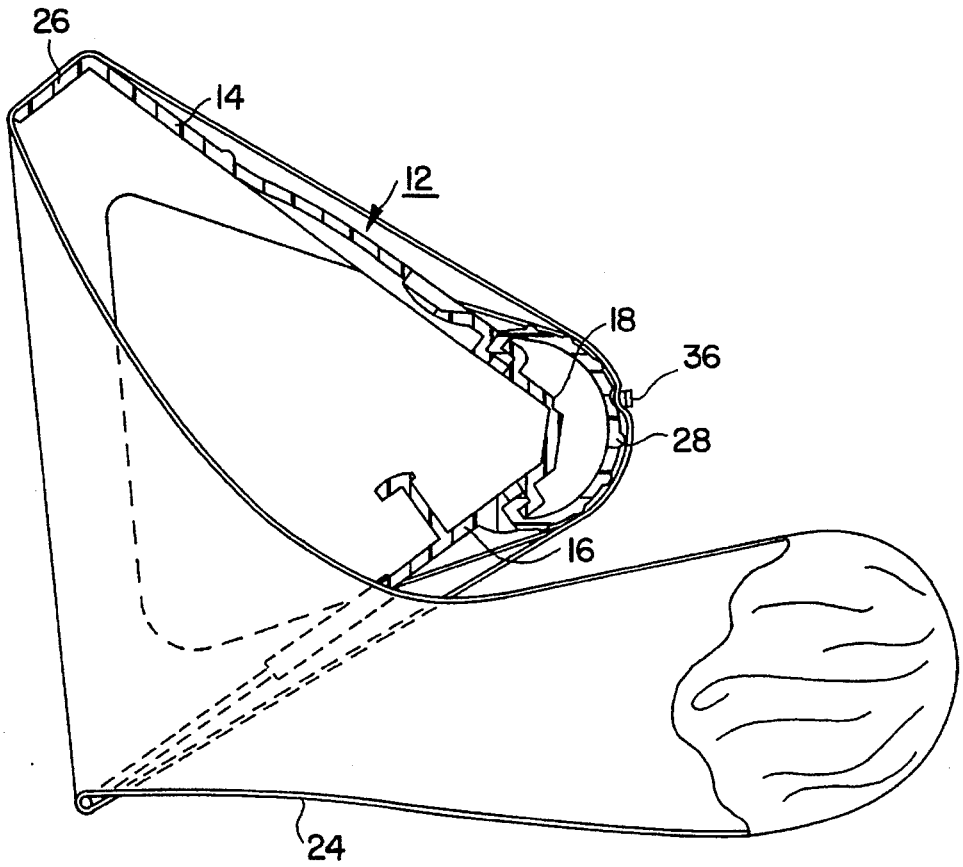
FIG. 2 is a cross-sectional view taken at line 2—2 of FIG. 1.
Figure 3:
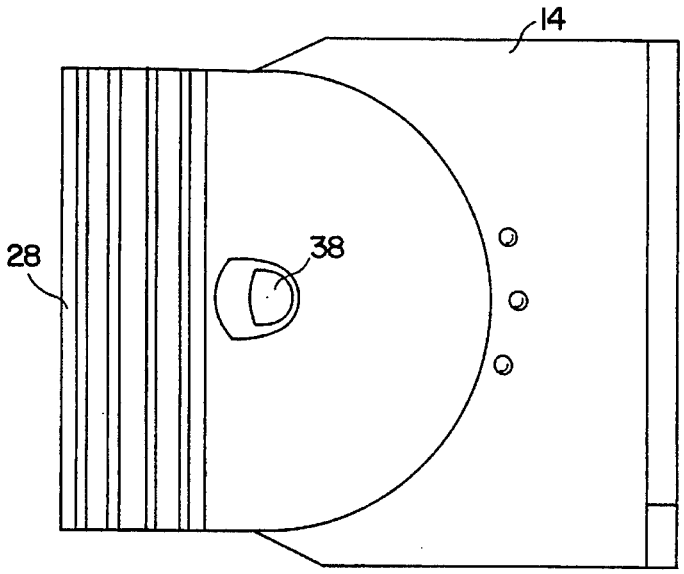
FIG. 3 is a top view of the waste container.
Figure 7:
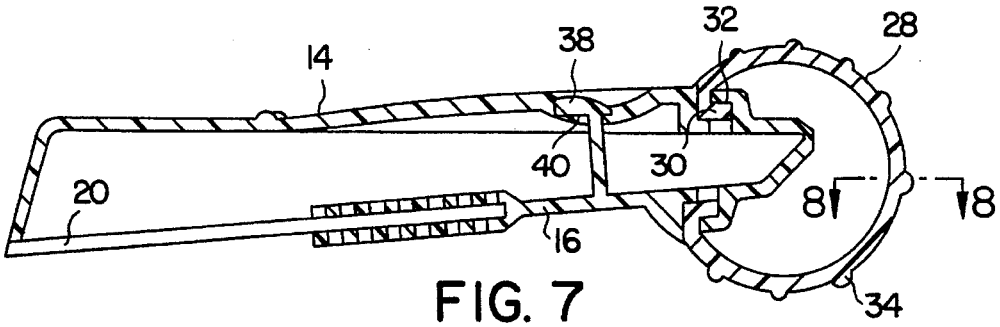
FIG. 7 is a cross-sectional view of the waste container.
Figure 8:
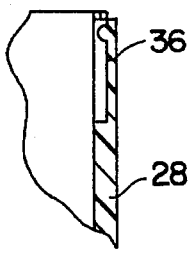
FIG. 8 is an enlarged cross-sectional view taken at line 8—8 of FIG. 7.
Figure 9:
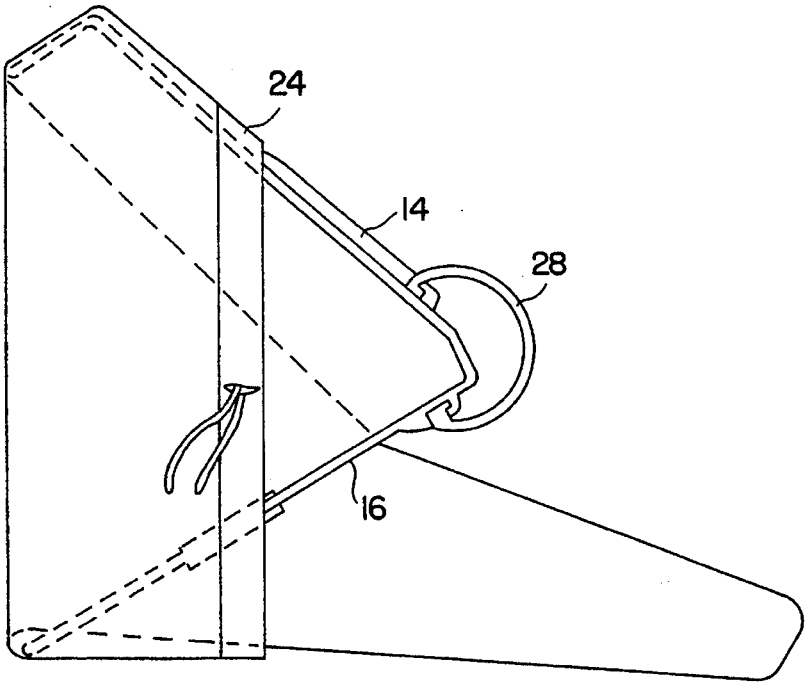
FIG. 9 is a side view showing a disposable bag with a drawstring, coupled to the waste container.

The container 10 has an arcuate shaped handle 28 that is attached to both the first 14 and second 16 walls. The handle 28 is typically constructed from a molded plastic material which has enough resiliency to provide a spring force that biases the walls 14 and 16 into the open position. As shown in FIG. 7, the plastic handle piece 28 may have a pair of flanges 30 that are snapped into corresponding notches 32 of the walls to attach the handle 28 to the body 12. The handle 28 may also have ridges 34 and a pair of clips 36 that can be deflected to provide a clamping force which holds the disposable bag 24 in place. The clips 36 typically secure the handles of the disposable bag which are wrapped around the container handle 28 as shown in FIG. 2. As shown in FIG. 9, the waste container 10 can also be used with disposable bags 24 that have a drawstring.

Figure 4:
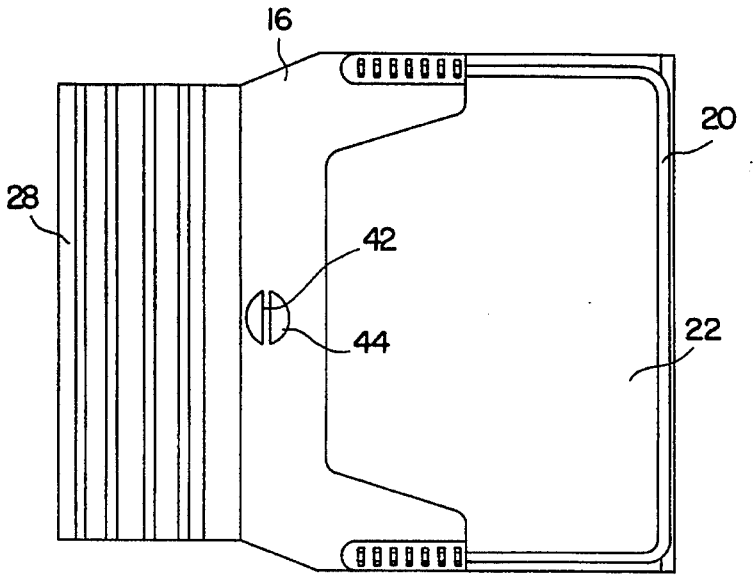
FIG. 4 is a bottom view of the waste container.
Figure 5:
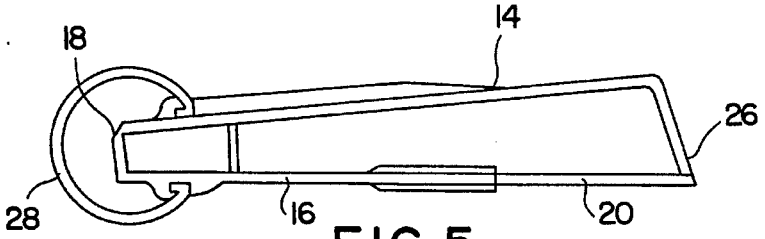
FIG. 5 is a side view of the waste container in a closed position.
Figure 6:
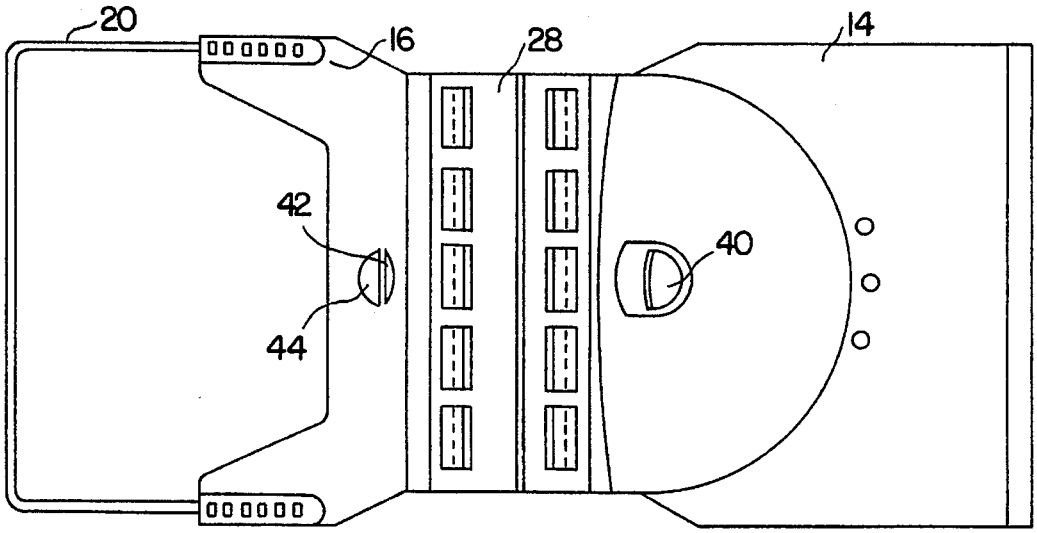
FIG. 6 is a top view showing the waste container in a fully open position.

As shown in FIG. 7, the container 10 may further have a locking tab 38 that cooperates with an aperture 40 in the first wall 14 to maintain the walls in the closed position. The tab 38 can be released from the first wall 14 by depressing the tab 38. To increase the flexibility of the locking tab 38, the tab 38 may extend from a beam 42 that extends across an aperture 44 of the second wall 16 as shown in FIGS. 4 and 6.

In operation, the user opens the container 10 and wraps a disposable bag 24 around the wire 20 and the lip 26 of the first wall 14. The bag 24 may be secured to the body 12 by the clips 36. The user can then close the walls 14 and 16 so that the locking tab 38 snaps into position. To collect waste, the user may depress the tab 38 so that the handle 28 moves the walls to the open position. The waste is then scooped into the disposable bag 24 and the walls are closed to seal the waste within the container. The waste can be removed by merely opening the walls and detaching the bag 24 from the body 12 of the container. The waste container of the present invention is easy to carry, store and use. Additionally, the minimal number of components, and the ability to mold the parts from plastic, provide a waste container that is relatively inexpensive to produce.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A waste container, comprising:

a body that has a first wall and a second wall that rotate about a hinge formed within said body, said first and second walls can rotate between an open position and a closed position; and, an arcuate shaped handle attached to said first and second walls, said handle providing a spring force that biases said walls into the open position, said handle having a pair of clips.

2. The waste container as recited in claim 1, further comprising a lock tab that extends from said second wall and cooperates with an aperture in said first wall to maintain said walls in the closed position.

3. The waste container as recited in claim 2, wherein said lock tab extends from a beam that extends across an aperture in said second wall.

4. The waste container as recited in claim 1, further comprising a U-shaped wire that extends from said second wall.

5. The waste container as recited in claim 1; further comprising a bag that is captured by said walls.

6. The waste container as recited in claim 1, wherein said first wall has a lip.

7. A waste container assembly, comprising:

a body that has a first wall and a second wall that rotate about a hinge formed within said body, said first and second walls can rotate between an open position and a closed position;

an arcuate shaped handle attached to said first and second walls, said handle providing a spring force that biases said walls into the open position, said handle having a pair of clips;

a lock tab that extends from said second wall and cooperates with an aperture in said first wall to maintain said walls in the closed position;

a U-shaped wire that extends from said second wall and defines a bag opening; and, a bag that is captured by said walls and which extends through said bag opening.

8. The waste container assembly as recited in claim 7, wherein said lock tab extends from a beam that extends across an aperture in said second wall.

9. The waste container assembly as recited in claim 7, wherein said first wall has a lip.

* * * * *